US005122332A

United States Patent [19]

Russell

[11] Patent Number: 5,122,332

[45] Date of Patent: Jun. 16, 1992

[54] PROTECTING ORGANISMS AND THE ENVIRONMENT FROM HARMFUL RADIATION BY CONTROLLING SUCH RADIATION AND SAFELY DISPOSING OF ITS ENERGY

[76] Inventor: Virginia Russell, 435 Crescent Ave., Buffalo, N.Y. 14214

[21] Appl. No.: 442,442

[22] Filed: Nov. 28, 1989

Related U.S. Application Data

[63] Continuation of Ser. No. 320,787, Mar. 9, 1989, abandoned, which is a continuation of Ser. No. 427,161, Sep. 29, 1982, abandoned, which is a continuation-in-part of Ser. No. 933,529, Aug. 14, 1978, abandoned, which is a continuation of Ser. No. 781,503, Apr. 13, 1977, abandoned.

[51] Int. Cl.[5] ..... G21C 9/00

[52] U.S. Cl. ..... 376/288; 376/321; 310/301; 310/304; 310/305; 429/15; 136/202; 136/253

[58] Field of Search ..... 310/301, 304, 305; 429/15; 136/202, 253; 376/320, 321, 288

[56] References Cited

U.S. PATENT DOCUMENTS

| | | | |
|---|---|---|---|
| 2,837,666 | 6/1958 | Linder | 310/305 |
| 2,847,585 | 8/1958 | Christian | 376/320 |
| 3,591,860 | 7/1971 | Sampson | 376/320 |
| 4,178,524 | 12/1979 | Ritter | 310/304 |

*Primary Examiner*—Brooks H. Hunt
*Assistant Examiner*—Ngoclan T. Mai
*Attorney, Agent, or Firm*—Burns, Doane, Swecker & Mathis

[57] ABSTRACT

A radiation gradient is utilized to transform harmful radiant energy into safer, more useful forms, thus collecting, controlling and consuming the energies of radiant emissions and protecting the environment and living organisms from them. More specifically, there is disclosed a new process for shielding emitters of harmful radiation by establishing an electrical circuit, which process includes shielding the source of radiation while collecting the energy of relatively more radiation on an electrically conductive material and collecting the energy of relatively less radiation on other electrically conductive material, which may include a ground or external sink, thus establishing a difference in electrical potential, and transferring this potential difference, along with any potential difference from auxiliary devices, outside the shielded area, to resistors and/or variable other loads, which consume the voltage as it is created. In this way emissions of radiation are converted to electrical energy and are controlled and the source of radiation is better shielded because the described process prevents build-up of energy within the shielded area and prevents consequent deterioration of the shielding material, thus preventing flash-overs, accidents, breaks and leaks in the shielding and providing greater protection of living organisms.

31 Claims, 1 Drawing Sheet

PROTECTING ORGANISMS AND THE ENVIRONMENT FROM HARMFUL RADIATION BY CONTROLLING SUCH RADIATION AND SAFELY DISPOSING OF ITS ENERGY

This application is a continuation of application Ser. No. 07/320,787, filed Mar. 9, 1989, which was a continuation of application Ser. No. 06/427,161 filed Sept. 29, 1982, which is a C-I-P of Ser. No. 05/933,529 filed Aug. 14, 1978, which is a continuation of Ser. No. 05/781,503 filed Apr. 13, 1977, all abandoned.

INTRODUCTION

Prior to the present invention it had been widely considered in the scientific community that gamma radiation could not be successfully directly converted to electricity. Subsequently, in U.S. Pat. No. 4,178,524, issued Dec. 11, 1979 but identified as a continuation-in-part of an application filed Sept. 1, 1976, Ritter taught that a nuclear electrical battery could be made, using a monoenergetic gamma ray source, which source would emit no high-energy charged particles. The present application traces back to one filed after Ritter's earliest date but it claims an effective invention date earlier than that of Ritter. The present invention distinguishes over Ritter in concept and in processing steps. It relates to protecting organisms and the environment from radiation by controlling such radiation, and does not relate merely to the production of an electrical battery, utilizing a source of nuclear energy. Further, the invention is applicable to use with various sources of radiant emissions, including those of heterogeneous radioactive wastes, and it helps to stabilize electrically conductive shielding materials which may be employed.

SHORT DESCRIPTION OF EMBODIMENTS OF THE INVENTION

The present apparatus and process include:

A. Shielding the source and emissions of radiation;

B. Establishing a radiation gradient between a part of the device absorbing considerable radiation and a part of the device absorbing less radiation;

C. Converting energy of this radiation gradient into electrical energy or voltage by direct conversion, photo-voltaic action, Compton effect, ionization by pairing; or other known means of conversion;

D. Conducting this energy outside the shielded area to a load or loads where it is consumed;

E. Monitoring the flow of current and/or voltage and adjusting a variable resistance or other load so it will consume most of such radiation energy as it is produced.

This invention controls the emissions of radiation, prevents dangerous build-up of voltage which can cause cold emission and perhaps, flash-overs, accidents or leaks in the shielding. It is for the purpose of protecting organisms and the environment, and is an improvement over existing methods of radiation-emitting devices and materials.

FEATURES OF THE INVENTION AND DISTINCTIONS OVER PRIOR ART

This invention is an improvement in present shielding methods for sources of harmful radiation. It shields the source of the radiation and the emissions, and at the same time converts the energy of the radiation absorbed by the shielding or auxiliary devices into electrical energy, which it controls and consumes outside the shielded area, thus substantially reducing random emissions of radiation to the environment, and preventing energy build-up, flash-overs, and consequent tendency of the shielding to deteriorate, thereby preventing accidents and damages to the shielding. Of significant importance is the "safety valve" effect of the invention, which protects the shielding, helps to prevent damage to the container, and thus prevents leakage.

The purpose of this invention is to protect the environment from harmful radiation from emitters of such radiation, particularly from nuclear wastes in their many forms. It cannot be tenably maintained that this process was obvious to anyone knowledgeable in the field of nuclear physics because there were many years when the need for the invention was great but it did not occur to others. In 1950 Samuel Glasstone's classic "Sourcebook on Atomic Energy" said:

> "The problem of shielding sources of radiation has been studied extensively from both experimental and theoretical points of view. It is of course a matter of the utmost importance."

but his book recited other means of shielding and made no mention of the method employed in this invention. Twenty-eight years later the Union of Concerned Scientists was advocating shut-down of construction of nuclear power plants until some solution to the nuclear waste problem was found. Billions of dollars were being spent studying safe disposal of nuclear wastes but none of the studies mentioned the process described herein as a possible solution. In 1978 Dr. Cunningham, in charge of nuclear wastes for the Energy Research and Development Administration (ERDA) and later for the Department of Energy (DOE), wrote:

> "The process of converting the energy from radioactivity into electricity has been demonstrated but never been applied to heterogeneous nuclear wastes."

Processes for safely disposing of nuclear wastes were directed to recycling the wastes in reactors, treating them chemically, burying them, shooting them into space, dispersing them, changing their physical forms into gases, liquids or solids, cooling them in water or air and releasing the heat and other radiation to the environment, and just placing them in shielded containers. These methods treated the whole radioactive molecule, while the method of the present invention treats the emissions from the molecules, while confining the molecules. The present process not only shields the environment from the radioactive wastes but it also provides a circuit that collects the radiated emission energy and conducts it through an electrical circuit where the excess energy can be consumed in environmentally acceptable forms. This is an entirely new way of shielding radioactive material.

There have been patents for nuclear batteries, designed as power sources for use in remote areas, generally in satellites, where releases of harmful emissions do not seen to constitute as great an environmental problem. These batteries, and their construction and use differ from the present invention in the following ways:

1. Few, if any attempts were made to protect the environment, and no attempts were made to control secondary emissions from shielding or to carry off and consume excess energy from the radiation.

2. The purpose was to produce maximum power with the least weight. The purpose of the present invention is to protect the environment by improving methods of shielding and by controlling excess emissions of radiation.

3. Many nuclear batteries are considered hazardous to health. According to existing patents, when a nuclear battery is brought to an area it may increase the harmful radiation in the area. With the present process excessive radiation inside the shielding is decreased, thus protecting the shielding, improving functioning thereof, and protecting the environment outside the shielding by consuming the excess harmful radiation in environmentally acceptable ways.

4. Existing nuclear batteries require specific isotopes for their source of radiant energy. The use of the present invention is not limited to a specific source but will also allow a considerable reduction in the amount of radiation emitted to the environment, and thus protects the environment.

5. Present devices provide no safety-valve or similar mechanism to prevent flash-over, or to prevent damage to the shielding. Shielding failures have already caused leaks and pollution of earth, air and ground water.

6. Prior art devices provide no mechanism to protect against any cold emissions, which occur when a voltage gradient reaches about $10^6$, while the instant process prevents such build-up of voltage.

7. Prior art devices provide passive shielding, such as layers of lead, concrete, earth, carbon steel, etc. Such shielding allows the escape of some harmful gamma rays and the conversion of others into heat. This heat could build up and cause problems for the shielding. Such passive shielding is often subjected to more radiation than it can successfully absorb, which can cause damages from drying, cracking, etc., allowing emissions of radioactive materials that are more dangerous to living organisms than simple radiation, because the radioactive molecules may be deposited on or taken into the human body where they continue to radiate. The present invention is concerned with limiting the amount of radiation buildup contained in the shielding and with protecting the shielding from deterioration due to the radiation, thereby preventing breaks and leakage developing in the shielding.

8. Most nuclear batteries establish a voltage difference between the source of radiation and other parts of the device but the present invention also employs the voltage created between layers of shielding. Additionally, unlike the instant invention, existing nuclear batteries do not provide for varying the loads or resistances to use the electricity as it is produced.

9. Devices like that described by Ritter are limited to a small amount of a certain type of radioactive material of limited energy while apparatuses and processes of the present invention apply to widely variable amounts and types of radioactive materials. Such quantities may be millions of times the amounts cited in the Ritter patent, and may include individual emitters with energies of ten times (or more) the limit mentioned by Ritter. It cannot be justifiably said that what applies to small amount of nuclear waste also applies to millions of times as much. It is well known that only slight changes in mass convert a relatively safe amount of potentially. fissionable material into a nuclear device.

DISTINCTIONS OVER CLOSEST REFERENCE

The alleged "prior art" patent which appears to be most relevant to the present invention is U.S. Pat. No. 4,178,524, of James C. Ritter. The earliest filing date of this patent or any parent application is Sept. 1, 1976, which was after experimentation that the present inventor had conducted. In such work she had demonstrated that nuclear waste emanations could be converted to electricity, so as to change the radiation energy to electrical energy, using foils of different metals as shields, after which such energy was consumed. Thus, the radiant energy from nuclear waste had been controlled.

Although it is considered that the present inventor's work preceded the filing of Ritter's earliest patent application, various important differences between this invention and that of Ritter will be set forth below to further establish patentability of this invention.

1. Although there has been a definite need in the nuclear field for a solution to the nuclear waste problem, Ritter's process does not provide any solution of the nuclear waste problem. Ritter never suggested that his invention was useful in solving this problem, and this was at a time when solving such problem was a major research effort of scientists throughout the world. The purpose of the present invention is to protect the environment by converting nuclear emanations to electricity and consuming the energy in environmentally acceptable forms, thereby preventing emissions of radiation to the environment. Such is an important distinction between this patent application and all others.

2. Ritter's invention does not allow for working with heterogeneous wastes. He applies it only to gamma rays of energy less than 1 Mev, thus barring alpha particles, beta rays and gamma rays from 1 to 10 Mev. The invention of this patent application treats all of these.

3. Most collections of nuclear wastes contain high energy emitting materials, as do the tanks of waste at West Valley, N.Y., for example, but Ritter's patent specifically states that his radioactive sources "have the desirable characteristic that they emit no high-energy charged particles."

4. The Ritter patent discloses that the value of his resistance will be chosen to maximize the power delivered to the electrical load. According to the present invention the emissions from the radiation source determine the power, which is consumed as it is produced.

5. Ritter's patent does not even mention the load being adopted to consume all the "gradient" energy produced, as it is produced.

6. Ritter describes his invention as "remote". The present invention is not remote. In fact, it may desirably be located next to power plants or hospitals or other places that generate nuclear wastes, and electrical energy can be fed back into the system, avoiding the dangers of transporting nuclear wastes).

7. A very important aspect of the present invention is improving the shielding of sources of radiation by drawing off and consuming the build-up of energy in the shielding and in the field around the shielding. Ritter's invention shows no concept of this and does not suggest it. All Ritter says about shielding is "In order to prevent an outside radiation hazard, the radioisotope source and plates can be contained within a lead housing 13." and "The thickness of the lead housing must be sufficient to attenuate the radiation emitted by the source or sources." A preferred embodiment of the present invention includes shielding which surrounds a mass of nuclear waste mass. In FIG. 1 of Ritter's patent the radioactive source is located at the left, next to the lead housing, and thus this device does not shield the environment from the source left side except through the passive lea shielding. FIG. 2 of Ritter's patent shows the absorbing material to be arranged so that it does not enclose the source, "radiating" out from the source in such manner as to leave far more open space than shielding about the source.

8. Ritter limits the radioactive source to less than 1 Mev. Tank 8D2 at West Valley, N.Y. contained 117,200 watts of radiation (Western New York Nuclear Service Center Companion Report). Clearly the Ritter patent cannot be considered as suggesting treatment of the West Valley waste with the present process, which is a main objective of the present invention.

9. Ritter's patent is also very different from the present invention in that it is very specific about the particular combinations of elements to be employed. The present invention does not require use of two different metals. Thus, if one metal is used, which is possible, Ritter's teaching would not apply. The present invention allows the plates to be of the same material or of several different materials. Furthermore, Ritter's teaching does not apply to uses of metals of:

1. Z of 23 through 46, and Z above 46;
2. Z of 23 through 46, and Z below 23;
3. Z of 23 through 46, and Z of 23 through 46.

Thus, Ritter does not include such material as copper, nickel, manganese, chromium, iron, ruthenium or other such materials that are conductive, available and relatively inexpensive, or pairs of metals such as aluminum and copper, copper and lead, or layers of aluminum and copper, covered with layers of copper and lead. Yet, all such combinations of metals are operative within the present invention.

Until very recently, harmful radiated emissions from high power electrical transmission lines, television and visual display equipment, X-ray machines, microwave devices milliwave devices and other such emitters have had only passive shielding, if any, applied to them, with no attempt being made to control any random emissions to the environment by cutting down the electromagnetic field near the source by shielding with conductive materials and at the same time collecting the energy absorbed from the radiation by the shielding, and consuming and controlling this energy, thus preventing such random emissions to the environment and improving performance of the shielding and of the equipment. Furthermore, no patents describe applying the present invented apparatuses and processes to such equipment.

There has been growing concern about better shielding for such devices, especially since recent tests have shown that long term low level radiations can cause cancer. Accordingly, application of the present invention to shielding and protecting the biosphere (organisms and their environment) from such radiation emitters is also useful.

THE NEED FOR THE INVENTED PROCESS

Experts in the nuclear field have recently stated that there is no known process for reucing the toxicity of radioactive wastes to such a level that they would be safe and would not pollute the environment. At present treatment of the waste is by treating the chemicals which are radioactive. Nuclear wastes are separated and dispersed, concentrated and confined, transported and buried. Dispersal merely spreads out the radioactivity. Concentration makes it more intense. Changing chemical molecules by chemical processes does not eliminate it, nor does transporting it nor burying it. The invented process does not affect only chemical and/or physical changes. It actually controls and consumes the energy of the harmful radiation in environmentally acceptable ways.

The need for the present invention to protect the environment from radiation, whether from high power transmission lines, television and visual display devices, X-ray machines, gamma ray devices, nuclear batteries, microwave and milliwave devices and other such wave and particle emitters, is not yet clearly understood by the public or the experts in this field. However, as evidence of harm to organisms and the environment from such sources continues to accumulate it is believed that such need will be established.

NUCLEAR WASTE TREATMENT

The most crucial need for the invented apparatuses and processes is to protect organisms, especially humans, and the environment from the hazards of nuclear wastes. There are many different applications of the invention possible and the applications can be changed, as the nuclear wastes change, with time.

This invention is directed to shielding organisms and the environment from radioactive materials, especially radwaste. Any materials employed are for shielding, collecting energy of emissions, converting to electrical energy, and conducting and consuming this energy in environmentally acceptable form. It is considered that storing such energy in transportable electrical batteries or establishing other chemical or electrical gradients in material than can be stored or transported is the equivalent of use or consumption of energy.

ILLUSTRATIVE EXAMPLE

It appears that the high-level wastes at the West Valley Demonstration Project are to be "solidified in a form suitable for transportation and disposal by vitrification or by such other technology which the Secretary of DOE determines to be the most effective for solidification."

There are certain limitations it is desirable to meet in applications of the invention to the treatment of radwaste, especially solidified nuclear wastes. There should be a collector of sufficiently low atomic number and sufficiently high electrical conductivity so that it interacts with the lowest energy alpha and beta rays and with low energy gamma rays. A sufficient amount of total shielding is preferably connected into the conductive circuit so that a near zero quantity of gamma rays can be detected outside the shielding. The total mass of metal in the collector and of dielectric between different metal layers should be sufficient to slow down gamma rays and collect their energy into the circuit. Among processes that apply are direct conversion of some alpha and beta rays, the photoelectric effect, the Compton effect and electron-positron pairing. The embodiment illustrated is efficient for collection of energy from gamma rays. Such rays striking the shields of lead or "higher density material" are likely to reflect electrons back to the aluminum or lower Z metal where they are absorbed and give a negative charge to the circuit. Gamma rays of energy greater than 1.02 Mev can react with matter in the pair-production process, losing their energy to electron-positron pairs. Later the positron combines with an electron to produce gamma rays which can react photoelectrically with the less dense shielding. Thus, there is a reasonable probability for complete conversion of gamma rays to ionization energy if the block is large enough to permit the multiple processes to occur. In the Compton effect the gamma ray loses its energy to an electron and a photon of lesser energy which can then react again with the less dense shielding.

With heterogeneous wastes, it is difficult to predict the voltage that will be produced. Some alpha particles and beta particles negate each other's charges, giving off heat that can be converted to electricity by semiconductor cells in the shielding. Some particles get trapped in the medium and do not add to the voltage initially. There is more variation from a norm if the blocks are small because there are so many different time periods for emission, and there may be times of few emissions and times when many emissions occur simultaneously. Therefore, if the blocks are small it is best to combine the leads from the different blocks so that these differences are averaged out. Also a temporary opposing voltage can be applied to stimulate initial current flow.

To estimate the voltage to be produced one may employ the following equation:

$$\text{Voltage} = \frac{h \times \text{frequency}}{\text{charge of electron}} - \text{work function},$$

and may total the voltages for all the emissions normal for the materials.

Ideally the intensity outside the shielding should be 0, indicating no radiation energy is escaping. To estimate intensity one may use the equation:

$$\text{Intensity}_{outside} = \text{Intensity}_{o}^{(-\exp\mu)}$$

where e = base of natural logs x = path length $\mu$ = linear attenuation coefficient characteristic of specific material.

The intensity loss through the various thicknesses of shielding and dielectric materials can be estimated for the maximum energies of gamma rays expected and sufficient total shielding may be provided to halt the highest energy gamma rays. It is preferred for surfaces of the shielding to be slightly irregular in form. Thus, they can be corrugated or honeycombed, and normally they will not be perfect spheres, thus preventing too intense focusing of the radiation.

BRIEF DESCRIPTION OF THE DRAWINGS

The invention is illustrated by the accompanying drawing, in which:

In FIG. 1 shielding installation 11 for radioactive waste 13, shown as solidified in block form, includes, in order, starting with the location adjacent the waste, enveloping materials which are: thin relatively high density (and relatively high atomic number) metal collector 15 (which may be copper or silver, for example, or a combination of both); molded dielectric 17, thicker low density metal collector 19, e.g., aluminum, which is in honeycomb form and may be imbedded in the dielectric; dielectric 21; collector 23 like that of 15; dielectric 25; collector 27 like that of 19; dielectric 29; and lead shielding 31. The thin sections of metal mentioned above are preferably less than an electron range thick and the thicker sections are greater in thickness. The material of lower density tends to collect more electrons and so becomes more negative.

Figure 1:
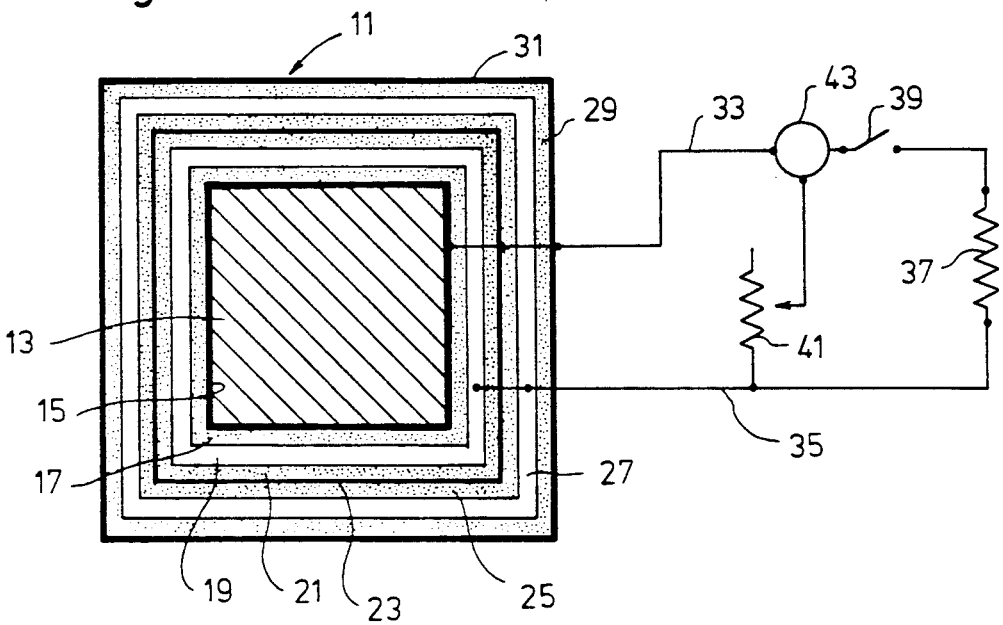
FIG. 1 is a schematic representation, partially in horizontal section, of an embodiment of the invention in which radioactive waste is shielded and its energy is drawn off.

The various sources of relatively positive and relatively negative electrical potentials may be separately connected, as illustrated (but with the + and − out of contact), or pairs of + and − potentials may be transmitted to a load where the energy is consumed. Thus, referring to FIG. 1, lines 33 and 35 connect the various sources of electricity from the radiation to resistor 41. The load may be varied, depending on the energy level, which may be read by meter 43 (a combination ammeter/voltmeter). Resistor 41 may be of the automatically adjusting type so that it draws off the maximum energy flow. If the energy level is sufficiently high switch 39 is closed and a large load 37 is introduced.

Figure 2:
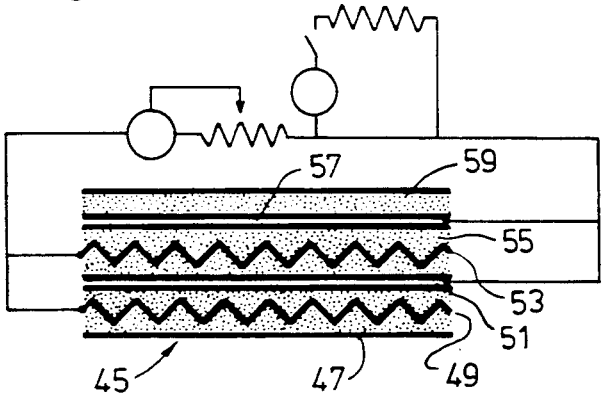
FIG. 2 is a similar representation, in partial vertical section, of a shielding "blanket" of this invention.

In FIG. 2 the protective blanket 45 comprises dielectric layer 47 with a relatively thick (and honeycombed) layer 49 of aluminum or "lower density" material molded into it, a relatively thin layer 51 of "higher density" metal, such as copper, aluminum 53 in dielectric 55, lead 57 and dielectric 59. Like the absorber of FIG. 1 the blanket apparatus also includes variable and fixed resistors, a switch and meters, as illustrated, and the various collectors may be similarly connected, as shown.

Various modifications of the apparatuses and methods may be made and employed. Additional loads may be introduced into the circuit by an automatic switch responding to increases in current flow and/or voltage, as shown by the ammeter/volt-meter. Other methods of conversion to electrical energy, such as semi-conductors, may be embedded in the shielding. The conductive materials, particularly the less dense materials are desirably honeycombed for greater absorption, and may be embedded in a dielectric. Also, diodes or other electrical aids may be employed to prevent back-flows of current inside the shielding.

With differently shaped blocks of wastes and with various forms of solidified nuclear wastes (or liquid wastes) various shapes of shielding may be used which are best adapted to the shape of the waste. How adequately the solid wastes are shielded also depends on cost and on where they will be stored. There are less expensive ways of making energy withdrawing circuits, as by including conductive circuits in blocks of solid waste, such as by use of a thin mesh of a material like copper that converts emissions by direct conversion and may establish a voltage difference with the lead casing or an outside sink. If only one kind of conductive material is used in the active area, it may last longer than two different materials that interact but it might product a lower voltage and could draw off less radiation energy. There can also be wires in spiraling shapes or otherwise dispersed throughout the block, for example, as a wire mesh. When two metals are used in proximity the amount of power produced may increase but the conductive materials may not be as long lasting. In determining what form of the invention to use and what materials to employ several things should be considered:

(a) Cost;

(b) Required length of life for shielding;

(c) Location and criticality of shielding required;

(d) Suitability of absorbing materials for absorptions at predominant emission energies; and (e) Cost of shielding vs. potential costs from harmful radiation.

In any event this invention provides a means for collecting and consuming radiant energy and thus improves the shielding of radiation emitters.

The present invention has been considered by the Department of Energy to be feasible but not cost-efficient. However costs of not protecting the environment sufficiently are not yet fully known and are mounting daily. In choosing applications of the invention, the object should be to get the most absorption and conduction of energy emissions from the vitrified waste material (or other deposit) while considering the cost and useful life of the shielding. Much study has been given to the kind of material to bind the nuclear wastes into blocks so this does not have to be mentioned except to say that it may be useful to have a thermal conductor located in the dielectric to prevent damage to the dielectric. Of course, opposing electrodes should be sufficiently far apart to prevent short circuiting. Also the circuit should be capable of tolerating alternating current, such as sometimes may be generated by a surge of alpha particles or powerful gamma rays being absorbed and converted to electricity. There are many nuclear waste problems to be solved: what to do with nuclear plants being decommissioned; what to do after an accident has occurred; and what to do with liquid wastes, gaseous emitters, etc. The application of the present invention to these problems will be described following the subsequent discussion of another embodiment of the invention, blanket shielding.

In FIG. 2 the top layer is of dielectric and subsequent layers are: a thin layer of lead; a thicker layer of dielectric; a layer of low density conductive material thick enough to absorb beta rays and electrons from gamma ray reflections and reactions; and a dielectric. Then there are repeated layers of higher density conductors, dielectric, thicker, less dense conductors, and dielectric. In making the blankets films can be used or layers of foil can be fixed by a castable and curable dielectric. In the blanket form the invention does not require as long lasting a dielectric as in the block form, because the blankets can be more easily replaced. Such materials as polyacrylate, mylar, castable polystyrene, teflon and polyisobutylene can be used. Epoxies, polystyrene, silicones, polyethylene, polypropylene and polyurethanes can also be used.

As with the apparatus shown in FIG. 1, the best choice of dielectric and conductive shielding materials will be based on the type of emitter and the estimated maximum energy of radiation, balanced against cost. Where there has been a nuclear accident the highest efficiency of shielding would be needed over the immediate area, perhaps several layers of blanket shielding ranging from thick aluminum levels alternated with thin copper levels, through aluminum and nickel and aluminum and silver to aluminum and lead, in repeated pairs. If the heat is too intense for aluminum, copper could be the thicker, more absorbent and less dense metal and could be alternated with thinner layers of a dense metal with high melting point. Away from the immediate area of the accident fewer layers of shielding would be needed and aluminum would probably be satisfactory. Further away it would be well to lay layers of aluminum foil on the ground at night with electrical connections and loads to pick up stray radiations and to consume the electrical energy created from the emissions. This aluminum would be washed off at appropriate intervals to clean it of radioactive molecules that might have adhered to it.

The various blankets, after use, should be treated as contaminated with nuclear wastes, and in very radioactive situations they would be cleaned or replaced after a set period. However, in accordance with the invention the shielding would not only physically hold back the molecules of radioactive material but it would also be connected so as to consume the energy of the emissions, thus preventing energy build-ups in the area, preventing further accidents and limiting harm to the environment. In extreme cases it might be necessary to let some of the heat go through the shielding to the outside atmosphere. In such a case the blanket shielding can be in the form of honeycombed mesh shielding, with tortuous paths therein.

OTHER ASPECTS AND USES OF THE INVENTION

Nuclear Accidents

Domes or Quonset huts can be constructed in accordance with this invention and can be installed over nuclear accidents, over nuclear plants being decommissioned, or over nuclear processing plants. They have the advantage over blanket shielding of allowing many layers of the dielectric air to slow down the emissions and ionize some of their energy, and they provide a larger volume of air to contain the heat emitted. Blanket shielding and dome shielding can be combined with mesh blanket shielding, such as is shown in FIG. 2, which can be dropped over the accident, carrying off and consuming much of the energy liberated. Then dome shielding may be placed on the blanket shield, carrying off and consuming more of the energy, and additional blanket shielding may be placed on top the dome.

Decommissioning Nuclear Power Plants

If plants to be decommissioned are to be left in place it is not enough to encase them in concrete. They should be contained in a structure or covered with blanket shielding as described herein. Firm plates of the shielding forced under the plant will extend the life of the shielding and protect the environment from seepage, leakage and emissions into the ground. Above-ground shielding may have to be replaced as it ages. For example, at first there may be active cobalt 60 present and later there may be isotopes of nickel and niobium emitting their characteristic radiations. Each metal has a peak frequency for emissions so in determining the type of shielding to use this should be taken into consideration along with cost and structural properties.

Wastes Immersed in Liquid

In the United States there are presently storage area and dumps containing millions of gallons of liquid wastes emitting high-level radiation. Included among such wastes are 600,000 gallons at West Valley; pools at power plants; caches at hospitals; and miscellaneous sources. Water tends to neutralize the positive emissions of alpha rays and the negative emissions of beta rays and in this way helps hold down the build-up of energy in the radwaste containers. However, there will be preponderances of negative charges or positive charges at given moments, or over a period of time, which might cause an accident. It is important that such wastes be shielded as in this invention. In many cases the electricity produced by this invention can be fed back into the power supply, with care being taken that diodes, and/or other devices prevent any back flow of energy from the power supply to the container. The containers should be shielded physically as well as "electrically" to prevent the wind and evaporation carrying radioactive particles into the air.

Wastes Being Transported

Radioactive wastes should be transported in containers that use this invention in the shielding and the electrical load should be in the conveyance. For example, the electrical energy may be fed into the power system with proper precautions; it may be used for lights on the conveyance which will blink on and off and constitute a warning; or it may be used to sterilize material or dry material that is being transported.

Processing Nuclear Wastes

When nuclear wastes are processed, particularly when evaporation occurs as in glassification, encapsulation in a resin, and in making calcines or other dry forms, it is most important that the processing area be shielded with this invention. If not, the air can become ionized and accidents may occur, unless the energy is consumed. If the processing area is not shielded properly not only emissions but actual radioactive molecules may escape to the atmosphere, and be inhaled or ingested. This is particularly true when liquid nuclear wastes are poured into absorbers, such as vermiculite, for shipping to a yet-to-be-found permanent depository. The processing area should be shielded by dome or blanket shielding, the containers should be a part of the shielding and the transport means should include a load for consuming excess energy, as in this invention.

Using Nuclear Wastes as an Auxiliary Source of Power

The circuit that conducts the potential difference from inside the shielding to a load can be connected with a source of power in a power plant. Thus, while nuclear power plants are cooling their wastes they can apply this invention, using shielding that collects the energy being radiated in the form of heat, alpha, beta and gamma rays, and other radiation, and transmits it back into the power system so the energy from the wastes contributes to the power supply while the power plant continues to operate steadily. For efficient operation auxiliary electrical equipment will bring the power supply from the wastes into synchronization with the major power supply and will prevent backflows.

Nuclear Batteries

This invention should be used around nuclear batteries because they are often emitters of harmful radiation. If the radioactive material is very small the device can be encapsulated like a pill in the shielding and the power drawn from the shielding can be returned to the battery. Thus, any harmful emanations are collected, controlled and consumed, and do not harm the environment, which may be an organism, such as a human being utilizing the nuclear battery.

Other Emitters

The present invention may be similarly applied to harmful radiation emitters other than radioactive materials, such as high power transmission lines, television and visual display equipment, X-ray machines, gamma-ray devices (which will be increasing in number), microwave and milliwave devices, and other such emitters. The invention is of a special process of shielding the device and of an apparatus for practicing the process. For example, X-ray machines are normally shielded by a certain thickness of lead but it is important to collect and control secondary emissions from the lead and to prevent buildups of ionization within the shielding by utilizing the present invention and consuming the electrical energy created by the energy of the X-rays and radiation.

With high power lines the carrier lines can be enclosed in the present shielding and the voltage collected can be added to the system. With visual display machines the invention can be incorporated into the usual shielding and the energy can be used to run heating coils or charge batteries outside the shielding or connected to the power supply. It may the supply of power will be small, but the protection to young children will be significant. The same is true for other radiation emitters. They need the described shielding so that the energy of the radiations may be controlled and may be prevented from harming organisms, including people, and the environment. There will be more and more electronic devices being used in the future and radiation from them should be shielded. Bare or primitively shielded radioactive and other radiation emitting sources should not be used to dry grains, sterilize milk, stimulate heart beats, etc. but the energy collected by this invention can be converted into safe radiation and with this invention, such devices may be used safely.

The invention has been described with respect to illustrations of preferred embodiments thereof but is not to be limited to these because it is evident that one of skill in the art, with the present specification before him, will be able to utilize substitutes and equivalents without departing from the invention.

What is claimed is:

1. A process for reducing present and potential harm caused by emissions from a radiation source comprising the steps of:

(a) substantially shielding the environment from said radiation source with a first layer of conductive material which absorbs a relatively great amount of radiation;

(b) providing a dielectric material against a surface of said first layer facing away form said radiation source;

(c) providing a second layer of conductive material outwardly of said dielectric material with respect to said radiation source, said second layer absorbing a considerably smaller amount of radiation than said first layer to create an electrical potential difference between said first layer and said second layer;

(d) connecting said first and second layer through an insulated circuit for conducting the potential energy between said first and second layer, said circuit including a variable external load outside the shielded area; and (e) automatically increasing the variable load when a flow of current increases between the first and second layer so that the load is sufficient to consume and convert to safe, environmentally acceptable forms, most of the electrical energy as it is produced from the radiation, thus, accomplishing the purpose of protecting the environment and living organisms by controlling emissions of radiation and safely consuming their energy and also preventing accidents from dangerous buildups of energy near the source thereof.

2. A process in accordance with claim 1 wherein (a) and (c) are used to contain the source in or are bound by multiple layers of conductive shielding separated by a dielectric or air, as in roughly spherical, cubic, or cup-like forms, or under dome-like structures, blankets of shielding, film-like encasements of shielding, or over underlying plates.

3. A process in accordance with claim 2 wherein the source is a source of nuclear wastes emitting alpha rays and a potential difference is created between a thin layer of conductive shielding closest to the source and which is capable of absorbing alpha rays, and other layers of shielding absorbing more beta and gamma ray energy.

4. A process according to claim 1 wherein (a) and(c) shield the source and the source is radioactive material, as in mill tailings, nuclear devices, such as batteries, emitting secondary emissions to the environment, heterogeneous nuclear wastes, all or part of decommissioned nuclear plants, (a) is a layer of relatively low density conductive material of sufficient thickness to absorb electrons from gamma rays and beta rays, and (a) is alternated with (c) which is a layer of conductive material of higher density and of thickness less than one electron range, so that a potential difference is created between the electrically connected layers of low density material and high density material.

5. A process according to claim 4 wherein the source is a source of heterogeneous nuclear wastes and alpha, beta and gamma rays are emitted from it and processed.

6. A process according to claim 5 wherein at least one of the alternate layers is a metal or an alloy or amalgam of a metal of atomic number greater than 23 and less than 46, as in combinations such as aluminum and copper, copper and lead, copper and silver, aluminum and phosphor bronze, carbon steel alloys and copper, carbon steel alloys and lead, nickel and lead, aluminum and nickel and phosphor bronze and lead.

7. A process according to claim 2 wherein at least some of the potential difference is created between the outermost layer of shielding (farthest away from the radiation source) and a layer of shielding absorbing more radiation energy.

8. A process in accordance with claim 1 wherein the source is shielded by an expanse of shielding and in which (a), (b) and (c) are of sufficient flexibility to cover the particular source, which may range from a few grains of radioactive powder to a whole area where a nuclear accident has occurred.

9. A process in accordance with claim 8 wherein (a), and (c) are in the form of metal cloth, film, tight mesh, foil, or thin layers of metal, which may be embedded in a dielectric material.

10. A process in accordance with claim 8 wherein (a) is conductive material of relatively low density but sufficient thickness to efficiently absorb electrons from gamma rays and electrons inside the shielding, and (c) is a layer of conductive material of relatively high density of thickness less than one electron range and which is less likely to absorb electrons, so that a potential difference is created between the electrically connected layers of (a) and of (c).

11. A process according to claim 1 wherein the source is liquid nuclear wastes, (a) is the metal lining of the container and any filaments or plates that may be attached to it, and (c) is a sink or ground outside the container so that the electrical energy which may build up inside the container where the liquid acts as a conductor is carried through the circuit and removed from the highly radiant area.

12. A process according to claim 1 wherein (a) is honeycombed.

13. A process according to claim 1 wherein the load includes feeding electrical energy into an electric power system with diodes to prevent backflow of current into the shielding and source areas.

14. A process according to claim 1 wherein the load includes running electric current through water to separate hydrogen and oxygen.

15. A process according to claim 1 wherein the load includes energy produced to heat matter and to sterilize it, as in sterilizing sludge, milk, soil, fertilizer or seeds, or in drying wood or concrete.

16. A process according to claim 1 wherein monitoring devices automatically increase the load when the flow of current increases or when the temperature inside the shielded area increases.

17. A process according to claim 1 wherein the source is shielded or the area to be protected is shielded.

18. A process according to claim 17 wherein the source is a device that emits microwaves and the shielding is around the source, as in ovens, or screens a protected area.

19. A process according to claim 17 wherein the source is an electrical transmission line and the shielding is molded into insulation of the line.

20. A process according to claim 17 wherein the source is a television, oscilloscope or other visual display equipment.

21. A process according to claim 17 wherein the source is a device that emits X-rays.

22. A process according to claim 17 wherein the source is an electrical generator.

23. A process according to claim 17 wherein the source is an emitter of gamma rays.

24. A process according to claim 1 wherein the source is a source of radioactive wastes from medical processes.

25. A process according to claim 1 wherein the source is a source of radioactive wastes from nuclear power 26. A process according to claim 2 wherein the source is a source of mill-tailings.

27. A process according to claim 2 wherein the source is a source of heterogeneous nuclear wastes.

28. A process according to claim 1 wherein the source is a high speed computing or print-out device and the purpose of the process is to improve the performance of the device as well as to protect the environment.

29. A process according to claim 1 wherein the source is a nuclear battery.

30. A process according to claim 1 wherein the source is an electronic control device.

31. A process in accordance with claim 1 wherein the material separating the conductive materials is air, the source of radiation is heterogeneous nuclear waste, the conductive materials and the separating air are in blanket form, adaptable to shield the environment form radiation emitted by the heterogeneous nuclear waste, and the external load, connected by the insulated circuit to the conductive materials, consumes the electrical energy generated from the nuclear radiation and prevents dangerous voltage buildup in the conductive materials.

* * * * *